US011241611B2

(12) United States Patent
Hutt

(10) Patent No.: US 11,241,611 B2
(45) Date of Patent: Feb. 8, 2022

(54) ILLUMINATED PIN GAME PLATFORM

(71) Applicant: FOWLING ENTERPRISES, LLC, Hamtramck, MI (US)

(72) Inventor: Christopher Hutt, Hamtramck, MI (US)

(73) Assignee: FOWLING ENTERPRISES, LLC, Hamtramack, MI (US)

( * ) Notice: Subject to any disclaimer, the term of this patent is extended or adjusted under 35 U.S.C. 154(b) by 51 days.

(21) Appl. No.: 16/325,907

(22) PCT Filed: Aug. 16, 2017

(86) PCT No.: PCT/US2017/047167

§ 371 (c)(1),
(2) Date: Feb. 15, 2019

(87) PCT Pub. No.: WO2018/035237

PCT Pub. Date: Feb. 22, 2018

(65) Prior Publication Data

US 2019/0209914 A1 Jul. 11, 2019

Related U.S. Application Data

(60) Provisional application No. 62/376,081, filed on Aug. 17, 2016.

(51) Int. Cl.
*A63D 1/04* (2006.01)
*A63D 3/00* (2006.01)
(Continued)

(52) U.S. Cl.
CPC ..... *A63D 1/04* (2013.01); *A63D 3/00* (2013.01); *A63D 5/04* (2013.01); *A63D 5/08* (2013.01); *A63D 7/00* (2013.01)

(58) Field of Classification Search
CPC ..... A63D 1/04; A63D 3/00; A63D 7/00
(Continued)

(56) References Cited

U.S. PATENT DOCUMENTS 2,014,306 A * 9/1935 Barker ..... A63D 5/04 473/69
2,210,398 A 8/1940 Dunlap
(Continued)

OTHER PUBLICATIONS

Fowling.org, "What is Fowling?"; "How to Build Fowling Lanes", fowling.org/How-To-Build-Fowling-Lanes.htm; "Equipment Required", fowling.org/Fowling-Equipment-Required.htm, archived on Apr. 18, 2010 (Year: 2010).*
(Continued)

*Primary Examiner* — Laura Davison
(74) *Attorney, Agent, or Firm* — Blue Filament Law PLLC

(57) ABSTRACT

A game platform and process of setting up and scoring individual game pins on the game platform is provided. The platform and process has utility to mitigate the negative impact of recurring manual setup of individual game pins on a game surface prior to beginning or continuing play such as the misalignment of individual game pins potentially creating an unfair advantage or disadvantage to those playing the game. The platform and process also has utility to increase the efficiency and uniformity of game setup and game play. The platform affords automatic identification of a misaligned game pin and notifies a player of the need to realign the game pin. The platform has further utility to automatically score the game and generate additional game information in real-time.

18 Claims, 4 Drawing Sheets

(51) Int. Cl.
*A63D 7/00* (2006.01)
*A63D 5/08* (2006.01)
*A63D 5/04* (2006.01)

(58) Field of Classification Search
USPC ..... 273/127 A, 393, 407; 473/102–105
See application file for complete search history.

(56) References Cited

U.S. PATENT DOCUMENTS 2,346,428 A * 4/1944 Hanley ..... A63D 9/00 473/69
3,117,785 A * 1/1964 Colton ..... A63D 5/04 473/69
3,140,872 A 7/1964 Bolger, Jr.
4,770,418 A * 9/1988 Schwiering ..... A63D 5/04 473/101
6,283,872 B1 * 9/2001 Lichodziejewski ..... A63D 3/00 473/116
7,022,024 B2 * 4/2006 Brim ..... A63D 1/04 473/115
7,030,736 B2 * 4/2006 Bouchard ..... A63D 9/00 340/323 B
8,925,926 B2 * 1/2015 Alway ..... A63B 63/08 273/371
9,782,666 B2 * 10/2017 Dahl ..... A63F 7/0017
2005/0164797 A1 * 7/2005 Jacover ..... A63D 5/04 473/70
2005/0272511 A1 12/2005 Bouchard et al.
2008/0312004 A1 12/2008 Connell et al.
2015/0273318 A1 10/2015 Christensen, Jr.

OTHER PUBLICATIONS

"Bowling pin shooting", Wikipedia, en.wikipedia.org/wiki/Bowling_pin_shooting, archived Jul. 5, 2015 (Year: 2015).*
International Search Report dated Nov. 27, 2017 for International Application No. PCT/US2017/047167 filed Aug. 16, 2017.

* cited by examiner

ILLUMINATED PIN GAME PLATFORM

CROSS-REFERENCE TO RELATED APPLICATION

This application claims priority of U.S. Provisional Patent Application Ser. No. 62/376,081 filed Aug. 17, 2016, which is incorporated herein by reference.

FIELD OF THE INVENTION

The present invention in general relates to a pin game platform and process of setting up and scoring the same; and in particular to an illuminated game platform projecting light beams in a predetermined configuration.

BACKGROUND OF THE INVENTION

Games involving the setting up, striking, and knocking down of individual game pins with an object such as a ball often require a game board to delineate the game area relative to the surrounding space. Individual game pins are set up on the playing surface in a predetermined orientation prior to beginning the game. Depending on the rules of the specific game, the individual game pins can be struck or knocked down with an object thrown or otherwise set in motion by a player. A player's progress can be scored in a variety of ways. For example, a player is rewards for the number of pins knocked down per toss or in a competitive timed fashion. Some games involving the setting up, striking, and knocking down of individual game pins are played recreationally Such games could also be played more seriously, for example, in a league-play format.

A recurring feedback loop occurs with respect to set up the individual game pins that were knocked down during the course of previous game play. The need to manually set up individual game pins on a game surface presents a variety of difficulties that result in imperfect pin placement, all the while creating camaraderie and part of the entertainment value. Some of these difficulties can negatively affect the uniformity, scoring, fairness and ultimately the enjoyment of the game. Using the example of a game that requires individual game pins to be set up in a specific predetermined orientation or specific location, misalignment of the individual game pins on the game surface, even ever so slightly, can cause a cascade of negative effects. The felling of the individual game pins becomes dynamic with inaccurate positioning. In a game played in multiple rounds, a variation in alignment of the individual game pins from round to round may affect a given player's performance, ultimately altering the total scoring. Such altered scoring would not be a true reflection of that given player's true acumen in the game. Players with more deviant intentions could purposefully misalign individual game pins to gain an advantage over an opposing player. Part of what gives games with individual game pins wide appeal is the notion that the game setup is inherently neutral. Part of the enjoyment of playing a game is the notion that each player must rely on an individual skill level honed over time to gain the edge over an opposing player. As such, preventing the cascade of negative effects that can flow from a misalignment of individual game pins resulting from the need for manual setup is of extreme importance.

The need to manually set up individual game pins on a game surface can also be a time consuming process. Depending on a variety of factors such as the total number of individual game pins required to be set up and the size of the game surface, the requisite manual set up could negatively impact the pace, and ultimately the overall enjoyment of the game. This inefficiency becomes more acute when the game is played in multiple rounds necessitating multiple set ups of the individual game pins to complete a single full game.

A further incident to playing a game is the need to manually score the game. Manual scoring carries with it many of the pitfalls outlined above including the potential for inaccuracies due to human error, intentional inaccuracies (cheating) and negative effect on the pace, and ultimately the overall enjoyment of the game. In timed scoring, such as FOWLING™, temporal scoring in a league context and difficult, and problematic in competitive play, as compared to recreational play.

Current game surfaces, processes for setting up games, and scoring games employed in the industry to address the inefficiencies and pitfalls stemming from a game with individual game pins requiring recurring manual set up on a game surface are not satisfactory in that they do not provide a game board with a built-in feature specifically included to aid in the uniform and efficient alignment of individual game pins on the game surface with every recurring set up. Simple outlines demarcating the predetermined location for an individual game pin on a game surface is not satisfactory when the game is being played in low ambient light conditions.

Thus, for games that require a predetermined orientation of individual game pins on a game surface, there exists a need for a game board and process of setting up individual game pins on the game surface that provides for efficient and uniform alignment of the individual game pins with each recurring setup. There further exists a need for a game board and process of setting up individual game pins on the game board that provides for automatic detection of a misaligned game pin that is also capable of automatically scoring the game and automatically generating game information in real-time.

SUMMARY OF THE INVENTION

An illuminated game platform is provided for supporting game pins. The illuminated game platform has a gaming board with a front edge, a back edge, side edges and a surface. The surface has a plurality of inserts, each of the plurality of inserts being transparent or translucent and flush with the surface. A base supports the gaming board. At least one light source is aligned with each of the plurality of inserts.

A process is provided for setting up a pin game that includes placing a plurality of game pins onto a gaming board in a predetermined orientation, the plurality of game pins being placed in an upright position; and upwardly illuminating the gaming board with a plurality of light sources aligned with the predetermined orientation. The process further includes changing the illuminating in response to misalignment of one of plurality of game pins, felling of one of plurality of game pins, or a combination thereof.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE INVENTION

An inventive game platform and process of setting up and scoring individual game pins on an inventive game platform is provided. The present invention has utility to mitigate the negative impacts of recurring manual setup of individual game pins on a game surface prior to beginning or continuing play such as the misalignment of individual game pins potentially creating an unfair advantage or disadvantage to those playing the game. The present invention also has utility to increase the efficiency and uniformity of game setup and game play. In some inventive embodiments, the present invention affords automatic identification of a misaligned game pin and notifies a player of the need to realign. The present invention has further utility to automatically score the game and generate additional game information in real-time.

It is to be understood that in instances where a range of values are provided that the range is intended to encompass not only the end point values of the range but also intermediate values of the range as explicitly being included within the range and varying by the last significant figure in the range. By way of example, a recited range from 1 to 4 is intended to include 1-2, 1-3, 2-4, 3-4, and 1-4.

Figure 1:
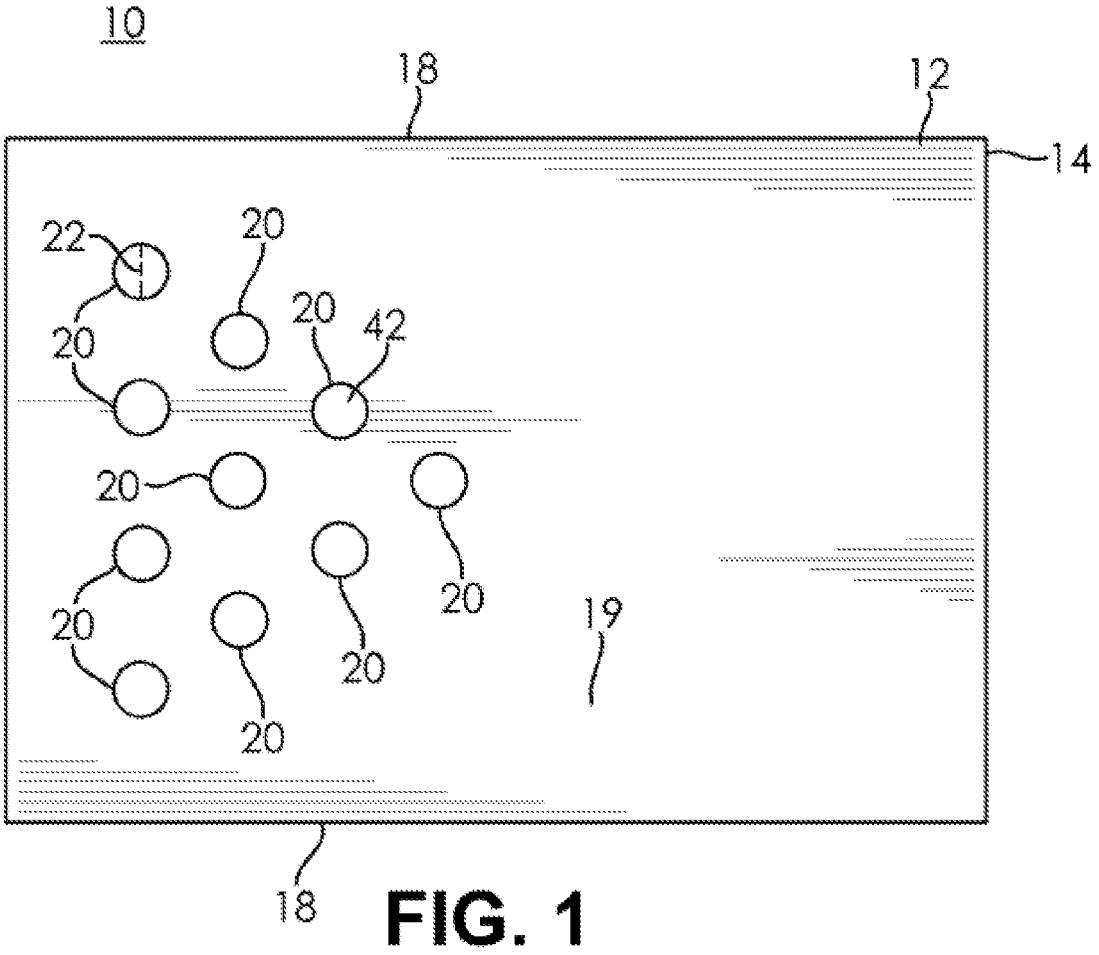
FIG. 1 is a top-down view of a game platform in accordance with an embodiment of the invention.

Referring now to the figures, FIG. 1 is a top-down view of the inventive illuminated game platform shown generally at 10. The game platform 10 has a game board 12 with a front edge 14, a hack edge 16, side edges 18, and a gaming surface 19. Surface inserts 20, each having an insert diameter 22 and placed in the surface 19. The surface inserts 20 are flush with the planar surface 19. The insert 20 is illustratively formed from a variety of transparent or translucent thermoplastic, thermoset, or glass materials. While the insert 20 is depicted as circular at the interface with the surface 19, it is appreciated that a variety of shapes are operative herein that include a star, a heart, an oval, a triangle, a square, other polygonal geometric shapes, a numeral, a letter, a symbolic shape, of an annular outline or any of the aforementioned. It is appreciated that an annular insert allows a border of light shafts to project upward to concentrate lumens of light around the periphery of a game pin 24, as compared to lighting a base of the game pin 24. It is appreciated that an opaque mask applied on a portion of the insert 20 defines the regions through which light is projected.

Figure 2:
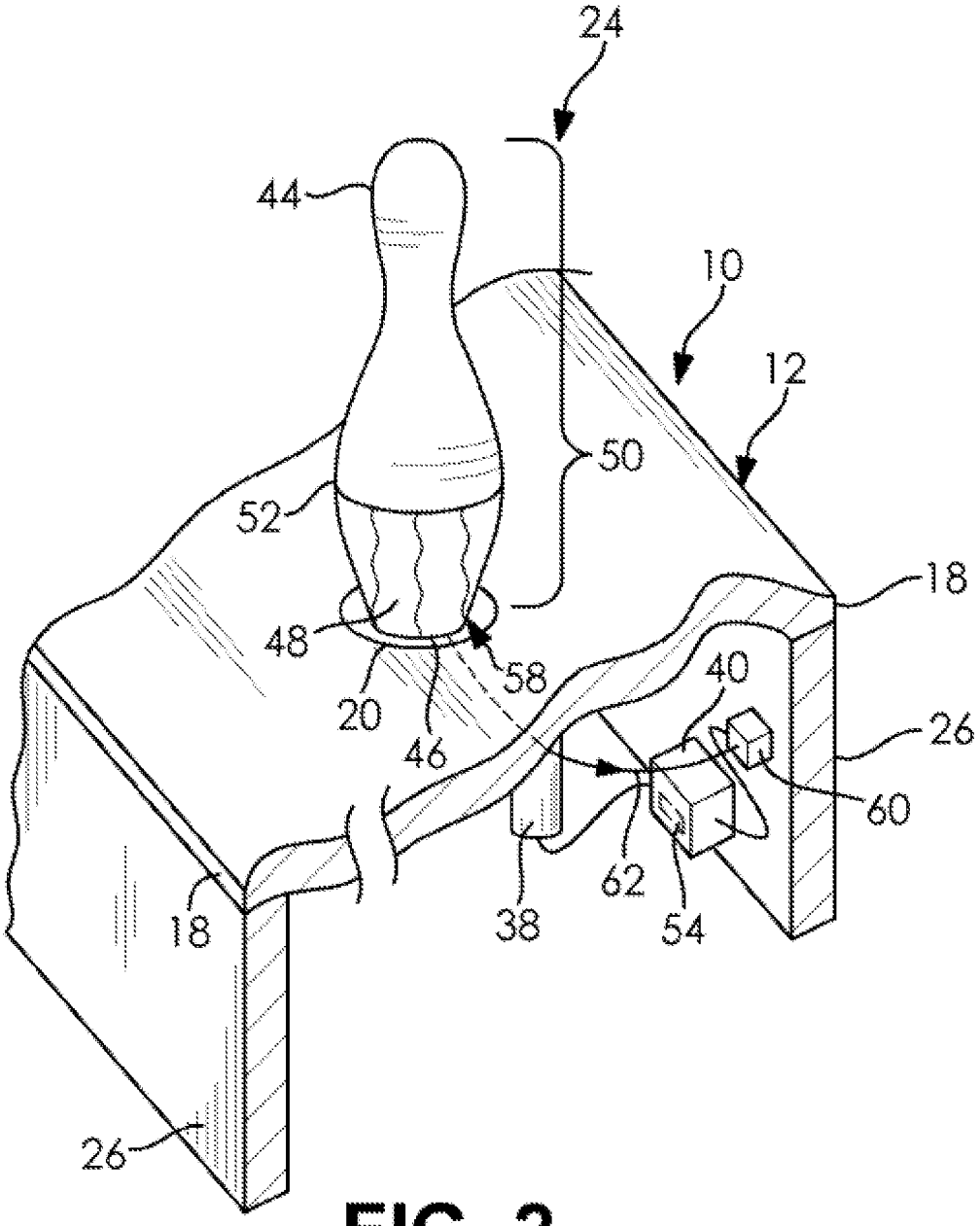
FIG. 2 is a perspective view of a game pin in accordance with an embodiment of the invention.

FIG. 2 is a perspective view of a game pin 24 positioned on a planar surface 19 in a game placing orientation. A game pin 24 has a pin top 44, a pin base 46 having a pin base diameter 48, a pin height 50 and a waist diameter 52 wherein the pin base 46 is distal to the pin top 44 relative to the pin height 50. Game pin 24 as depicted is a conventional tenpin pin. It is appreciated that a pin game is also played with pins that have different cross-sectional profiles than that of pin 24. Alternative pin shapes illustratively include fivepin, Canadian duckpin, American duckpin, and candlepin, with differences in height and relative diameters.

Figure 3:
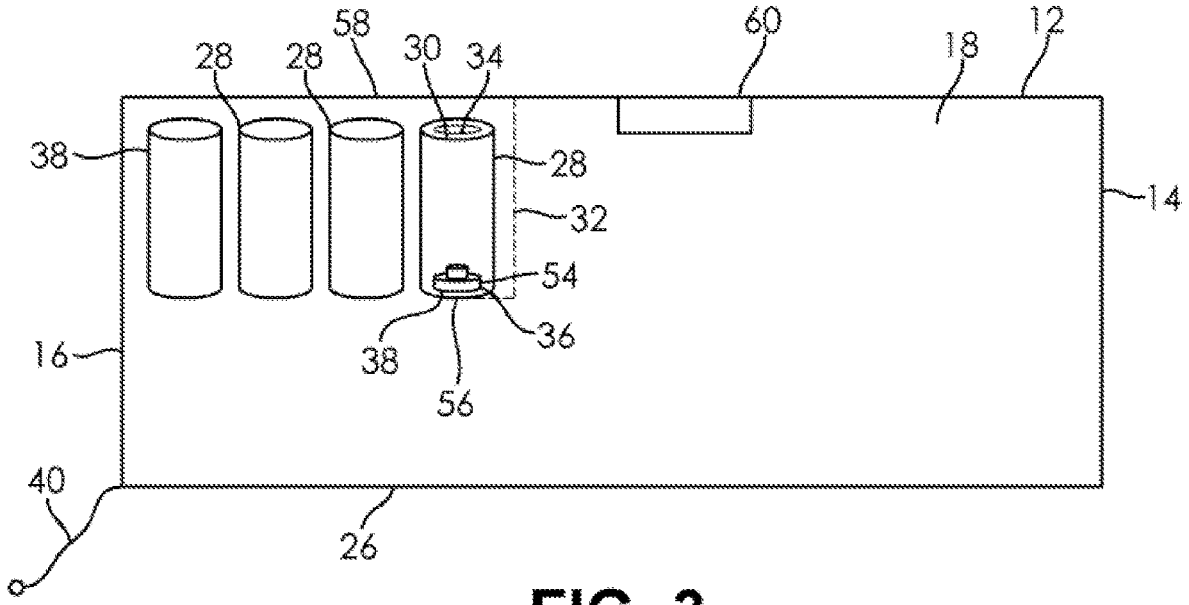
FIG. 3 is a partial cutaway side view of the game platform of FIG. 1 in accordance with an embodiment of the invention.

An inventive illuminated game platform 10 is shown in partial cutaway side view in FIG. 3, where like reference numerals having the meanings ascribed thereto in the aforementioned drawings. A base 26 underlies the gaming board 12. While the game platform 10 is depicted as a rectangular cuboid, it is appreciated that a game platform is readily formed in other top view shapes that illustratively include circular, oval, triangular, square, and regular polygonal shapes with 5 or more sides such as a pentagon or a hexagon. Multiple light canisters 28 are provided that each have a canister diameter 30, a canister height 32, a top end 34 and a bottom end 36 are positioned below the surface inserts 20 with the top end 34 proximal to the surface insert 20. The light projected upwards onto a game pin 24 is defined by the diameter 22 of the insert 20. The top end 34 of each of canister 28 is distal to the bottom end 36 relative to the canister height 32. In some inventive embodiments, the canister diameter 30 is equal to, or greater than the insert diameter 22 so as to define a shaft of light projecting through the surface 19. In specific inventive embodiments, the insert diameter 22 is between 0.1% and 30.0% greater than the pin base diameter 48. In still other inventive embodiments, the insert diameter 22 is between 0.5% and 20.0% greater than the pin base diameter 48. In other specific inventive embodiments, the insert diameter 22 is between 1% and 10% greater than the pin base diameter 48. In other inventive embodiments, the insert diameter 22 is between 1% and 10% greater than the waist diameter 52 of pin 24. As a result, upon illumination, shafts of upward projecting light reflect off the sides of a game pin 24 between the base 46 and waist diameter 52 to provide a lighting effect useful to a game player in aligning a given game pin 24 concentrically with insert 20, as evidenced by uniform side illumination of the game pin 24; as well as aiming a projectile during game play under low ambient light conditions that might be found in a pub setting. A light source 38 is placed within each light canister 28. It is appreciated that the light source 38 in some embodiments is one or more light emitting diodes (LEDs) of monochromatic or color changing light output. In still other embodiments, the light source 38 is a cold cathode ray tube or incandescent bulb. A power source 40 in electrical communication with a light source 38 include line power or a battery pack 54 contained within a housing 56. In some inventive embodiments, a light source 38 is serviced by elevating the platform 10 to expose the underside components, while in other embodiments a removable panel access door (not pictured) is used to access the underside components.

In some inventive embodiments, a sensor 58 is provided proximal to the insert 20 to detect the presence of a game pin 24 overlying a given insert 20. A sensor 58 illustratively includes a photometer, also known colloquially as an "electric eye", or a pressure sensor. In a preferred embodiment, each insert 20 present in a game platform has a sensor 58. A logic board 60 in electronic communication with all the sensors 58 present in the housing 10. The power source 40 in electrical communication with the sensors 58 and the logic board 60 to provide power thereto, or alternatively each has a separate power supply. In some inventive embodiments, the logic board 60 is operable to control the light source 38 as to illumination on/off, intensity, light output color, or a combination thereof. The sensor 58 generates an output signal 62 that is communicated to the logic board 60 indicative of a game pin 24 remaining in an upright position, the position of the game pin 24 relative to an insert 24, having been felled, or a combination thereof. The output signal 62 can in-turn be used to record a score with the proviso that all game pins 24 have underlying sensors, or change the lighting output as detailed above. It is appreciated that scoring can be temporal: time differential from first pin, $t_0$ to be felled to the time the last pin, $t_{final}$ is felled for all pins, numerical: number of pins felled by a single projectile throw, such location and number of pins felled in a given $t_{final}$-$t_0$ for each throw, or a combination thereof. The logic board 60 is appreciated to include an internal stop watch functionality or have input from a stop watch timer in scoring embodiments. The logic board 60 is coupled to a display 65 that generates scoring and other real-time game information to game players. It is appreciated that coupling the scoring information from different platforms allows for comparative league scoring to occur. The display 65 may be in wireless or wired communication with the logic board 60.

Figure 4:
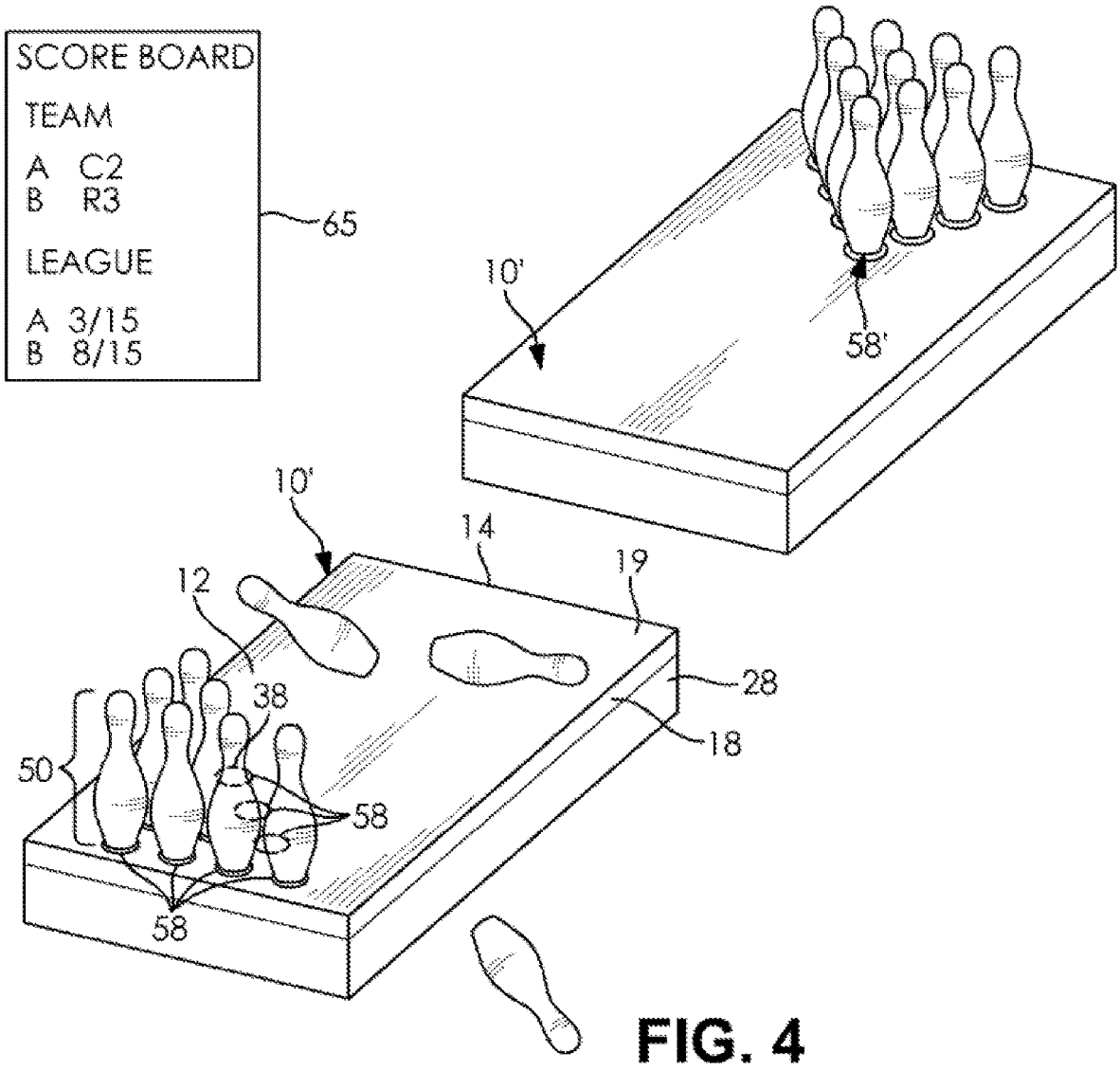
FIG. 4 is a perspective view of a FOWLING™ game arrangement according to the present invention.

A second game platform identical to the game platform 10 and denoted as 10' in FIG. 4 is positioned within a playing lane in opposition to the game platform 10 relative to the front edge 14 affords a game arrangement for a FOWLING™ game, in which like numerals having the meaning ascribed thereto in the aforementioned drawings. In this embodiment, ten game pins 24 are placed in an upright position onto ten surface inserts 20 such that game pins 24 and surface inserts 20 are positioned in an equilateral triangular formation. It is further appreciated that each of the plurality of game pins 24 and surface inserts 20 may be equidistantly spaced at a distance of less than the height 50 of each of the game pins 24. The game pins 24 are aligned in an upright position on the game platform 10 using light shafts projecting upward through inserts 20. It is appreciated that the light sources 38 allow for an efficient and uniform alignment of game pins 24 and minimizes the variability in alignment associated with manual pin set up. In embodiments in which the sensors 58 and 5W are present each platform 10 and 10' include the logic boards 60 and 60' are operable to indicate a misalignment of a given game pin 24 the felling of a given game pin 24, the timing of a given game pin 24 being felled, scoring, or a combination thereof. It is appreciated that the light output can change colors, intensity, or operate in an on/off fashion in response to a given sensed status. By way of non-limiting example, a red light output from light source 38 could indicate a misaligned game pin 24 whereas a light blue beam could indicate a properly aligned pin 24 while also providing a halo effect reflecting off of a pin 24 above-situated on a surface insert 20. A green beam could indicate a pin 24 knocked-down during the course of playing a game using the game platform 10 while also providing a columnar effect extending through a surface insert 20 and rising above the game platform 10.

As a person skilled in the art will recognize from the previous detailed description and from the figures and claims, modifications and changes can be made to the preferred embodiments of the invention without departing from the scope of this invention defined in the following claims.

The invention claimed is:

1. An illuminated game platform for supporting game pins comprising:

a gaming board having a front edge, a back edge, side edges, and a surface, said gaming board defining a rectangular cuboid;

a plurality of inserts, each of said plurality of inserts being transparent or translucent and flush and contacting with the surface of said gaming board;

a base supporting said gaming board elevated above said base;

at least one light source aligned with each of said plurality of inserts;

a plurality of game pins each of said plurality of game pins having a pin top, a pin base having a pin base diameter, a pin height, and a waist diameter, each pin base being opaque;

a set of photometer or pressure sensors that are individually positioned proximal to each of said plurality of inserts, each sensor adapted to detect at least one of concentric alignment of one of said plurality of game pins with said one of said plurality of inserts, the presence of one of said plurality of game pins, or the dislocation of one of said game pins;

wherein each of said plurality of inserts is configured to support the pin base of one of said plurality of game pins in plane with the surface of said gaming board and wherein each of said plurality of inserts has an insert diameter adapted for concentric alignment of one of said plurality of game pins; and wherein the insert diameter is between 1% and 10% greater than the waist diameter of the pin.

2. The game platform of claim 1 further comprising a power source of line power or a battery for energizing said at least one light source.

3. The game platform of claim 1 wherein one or more of said plurality of inserts is formed from transparent plastic.

4. The game platform of claim 1 wherein said plurality of inserts are ten inserts arranged in a triangular array.

5. The game platform of claim 1 wherein said game platform is a rectangular cuboid.

6. The game platform of claim 1 wherein all of said plurality of inserts have the insert diameter being the same and all of said plurality of game pins have the pin base diameter being the same.

7. The game platform of claim 1 wherein said plurality of inserts are circular.

8. The game platform of claim 1 wherein said at least one light source is at least one light emitting diode (LED).

9. The game platform of claim 8 wherein said at least one LED comprises a color changing LED.

10. The game platform of claim 1 further comprising a logic board electrically coupled to said at least one light source or said set of sensors.

11. The game platform of claim 10 wherein said logic board is coupled to both said at least one light source and said set of sensors, and each of said plurality of inserts has one of said set of sensors present and communicating an output signal to said logic board, said logic board compiling the concentric alignment of each game pin of said plurality of game pins with said one of said plurality of inserts, the presence of the game pin, or the dislocation of the game pin from all of said sensors.

12. The game platform of claim 11 further comprising a display.

13. A process for setting up and playing a pin game comprising:

placing said plurality of game pins of claim 1 onto said gaming platform of claim 1 in a predetermined orientation, said plurality of game pins being placed in an upright position with one pin of said plurality of game pins on each of said plurality of inserts;

upwardly illuminating said gaming board with said at least one light source aligned with each of said plurality of inserts, where each of said at least one light source is aligned with the predetermined orientation;

using a set of output signals generated by said set of sensors, where each individual output signal from the set of sensors is indicative of a corresponding game pin remaining in an upright position, the position of the game pin relative to the corresponding insert, the game pin having been felled, or a combination thereof; and communicating said set of output signals to a logic board to compute scoring of at least one of time differential from a first pin of said plurality of game pins, $t_0$ to be felled to the time the last pin of said plurality of game pins, $t_{final}$ is felled, a number of said plurality of game pins felled by a single projectile throw, location and number of pins felled in $t_{final}$-$t_0$ for each throw, or a combination thereof.

14. The process of claim 13 further comprising changing said illuminating in response to misalignment of one of the plurality of game pins, felling of one of the plurality of game pins, or a combination thereof.

15. The process of claim 13 further comprising scoring the felling of one or all of said plurality of game pins.

16. The process of claim 15 further comprising displaying the scoring to a game player.

17. The process of claim 16 further comprising compiling the scoring with scores from other games of the pin game and displaying comparative league scores.

18. The process of claim 13 wherein said plurality of game pins is ten game pins and another game board identical to said gaming board is placed in opposition thereto.

* * * * *